US010151043B1

(12) United States Patent
Berman et al.

(10) Patent No.: US 10,151,043 B1
(45) Date of Patent: Dec. 11, 2018

(54) METHODS OF PRODUCING COATED LOCATOR PINS AND LOCATOR PINS MADE THEREFROM

(71) Applicants: Solomon Berman, Carmel, IN (US); Ashok B Ramaswamy, Carmel, IN (US)

(72) Inventors: Solomon Berman, Carmel, IN (US); Ashok B Ramaswamy, Carmel, IN (US)

(73) Assignee: IBC TECHNOLOGIES, LTD., Lebanon, IN (US)

( * ) Notice: Subject to any disclaimer, the term of this patent is extended or adjusted under 35 U.S.C. 154(b) by 928 days.

(21) Appl. No.: 14/563,805

(22) Filed: Dec. 8, 2014

Related U.S. Application Data

(60) Provisional application No. 61/914,303, filed on Dec. 10, 2013, provisional application No. 61/918,557, filed on Dec. 19, 2013.

(51) Int. Cl.

| | |
|---|---|
| ***C25D 11/02*** | (2006.01) |
| ***C25D 11/04*** | (2006.01) |
| ***C25D 11/30*** | (2006.01) |
| ***C25D 11/26*** | (2006.01) |
| ***B23Q 3/18*** | (2006.01) |
| ***C23C 16/44*** | (2006.01) |
| ***C23C 16/50*** | (2006.01) |

(52) U.S. Cl.
CPC ..... *C25D 11/022* (2013.01); *B23Q 3/186* (2013.01); *C23C 16/44* (2013.01); *C23C 16/50* (2013.01); *C25D 11/04* (2013.01); *C25D 11/26* (2013.01); *C25D 11/30* (2013.01)

(58) Field of Classification Search
USPC ..... 219/158; 242/157 R; 428/457, 469, 472, 428/697, 698, 699, 701, 702, 408
See application file for complete search history.

(56) References Cited

U.S. PATENT DOCUMENTS 3,080,135 A * 3/1963 Steijn ..... B65H 57/24 242/157 R
3,130,938 A * 4/1964 Dysart ..... B65H 57/006 242/157 R (Continued)

FOREIGN PATENT DOCUMENTS

CN 103147107 * 6/2013

*Primary Examiner* — Archene A Turner

(57) ABSTRACT

A method of producing a locator pin with wear-resistant, corrosion resistant, and electrically insulating coating on selected areas of the surface off a metallic core include depositing a coating on the selected areas. The locator pin may have a single layer of a ceramic coating deposited using plasma electrolytic oxidation or may have a composite coating that includes a layer of vanadium carbide on selected areas of a surface of a locator pin and a layer diamond-like carbon on top of and in contact with the vanadium carbide layer. The vanadium carbide coating may be deposited using a thermal diffusion process and the diamond-like carbon coating may be deposited using a plasma-enhanced chemical vapor deposition process. The coating prevents weld splatter from adhering to the coated areas, and prevents the locator pin from acting as a shorting path during welding of parts located by the locator pin.

7 Claims, 6 Drawing Sheets

(56) References Cited

U.S. PATENT DOCUMENTS

| | | | | | |
|---|---|---|---|---|---|
| 4,043,623 | A * | 8/1977 | Rausch | B65H 57/24 | 242/157 R |
| 4,175,917 | A * | 11/1979 | Cotten | B26D 3/16 | 425/394 |
| 4,794,680 | A * | 1/1989 | Meyerhoff | B21B 27/005 | 492/54 |
| 6,175,097 | B1 * | 1/2001 | Raghavan | B23K 11/004 | 219/158 |
| 6,264,209 | B1 * | 7/2001 | Miya | B23B 13/125 | 384/907.1 |
| 2004/0028906 | A1 * | 2/2004 | Anderson | C03C 17/22 | 428/408 |
| 2006/0102253 | A1 * | 5/2006 | Berglund | C22C 38/06 | 148/318 |
| 2010/0247885 | A1 * | 9/2010 | Ito | C23C 14/024 | 428/216 |

* cited by examiner

METHODS OF PRODUCING COATED LOCATOR PINS AND LOCATOR PINS MADE THEREFROM

CROSS-REFERENCE TO RELATED APPLICATIONS

The present U.S. patent application is related to and claims the priority benefit of U.S. Provisional Patent Application Ser. No. 61/914,303 filed Dec. 10, 2013 and Provisional Patent Application Ser. No. 61/918,557, filed Dec. 19, 2013; the contents of both of these applications are hereby incorporated by reference in their entirety into the present disclosure.

TECHNICAL FIELD

The present disclosure generally relates to wear resistant and corrosion resistant coatings on metallic pins used in locating, guiding, or aligning objects used in various applications.

BACKGROUND

This section introduces aspects that may help facilitate a better understanding of the disclosure. Accordingly, these statements are to be read in this light and are not to be understood as admissions about what is or is not prior art.

Guide pins, also called locator pins, are used in various tooling applications to provide precise alignment or placement of certain parts prior to performing subsequent manufacturing processes. Processes where such locator pins are used to align various parts prior to subsequent processing include, but are not limited to, welding, aligning stacked or mating panels, and chases. The function of these pins is to align the parts consistently using reference holes or datum points.

Because of this repetitive insertion and removal, the pins are required to have adequate wear resistance for repeated motion against friction during the alignment process, and adequate corrosion resistance due to interactions with chemicals or vapors with which the pins can come into contact in the fabrication process. As these locator pins are used in aligning parts, for example, before resistance welding in applications like vehicle body fabrication, high wear resistance of these pins reduces the equipment downtime required for replacement of the pins and hence can result in lower operating costs.

Wear resistance is usually correlated to hardness of the coating. Pins used for aligning parts in the welding application also need to have high electrical insulation property in order to maximize the electrical current through the welding electrodes. During the welding process small particles of weld material are expelled from the welding operation called weld spatter that often adhere to the objects close to the welding area. Weld spatters on locator pins are undesirable as weld splatters make subsequent removal and insertion of the pins difficult. Low surface roughness of the pins is desirable as it allows for improved wear characteristics as well as easy alignment of the parts for welding.

While uncoated locator pins made of metals or alloys have the dimensional stability they lack adequate wear resistance and corrosion resistance properties required.

Thus a great need exists to produce locator pins, especially those containing a metallic core (such as aluminum or steel) with high wear resistance, high corrosion resistance, and low surface roughness. In addition, there is need for the locator pins to be electrically insulating. Further, it is highly desired to produce the ceramic coating by utilizing environmentally friendly processes with no hazardous by products whenever possible.

SUMMARY

A method of producing a locator pin with a wear-resistant, corrosion resistant, and electrically insulating ceramic coating on the surface of a metallic core of the locator pin is disclosed. The method includes depositing a layer of a coating using plasma electrolytic oxidation upon and in contact with selected areas of the metallic core of a locator pin.

A locator pin is disclosed. The locator pin includes a metallic core and a coating. The metallic core defines selected areas of a surface of the metallic core. The ceramic coating is characterized as wear resistant, corrosion resistant, and electrically insulating. The ceramic coating is deposited on the selected areas of the metallic pin.

Another method of producing a wear-resistant, corrosion resistant, and electrically insulating composite coating on a surface of a locator pin is disclosed. The method includes providing a metallic core made of steel. The method also includes depositing a first layer on selected areas of a steel pin, and then depositing a second layer on top of and in contact with the first layer.

A locator pin is disclosed. The locator pin includes a metallic core and a composite coating. The metallic core defines selected areas of the metallic core. The composite coating is characterized as wear resistant, corrosion resistant, and electrically insulating. The composite coating is deposited on and in contact with all or selected portions of the metallic pin. The composite coating may include a first layer deposited on the metallic core, and a second layer overlying the first layer.

BRIEF DESCRIPTION OF DRAWINGS

While some of the figures shown herein may have been generated from scaled drawings or from photographs that are scalable, it is understood that such relative scaling within a figure are by way of example, and are not to be construed as limiting.

DETAILED DESCRIPTION

Figure 1:
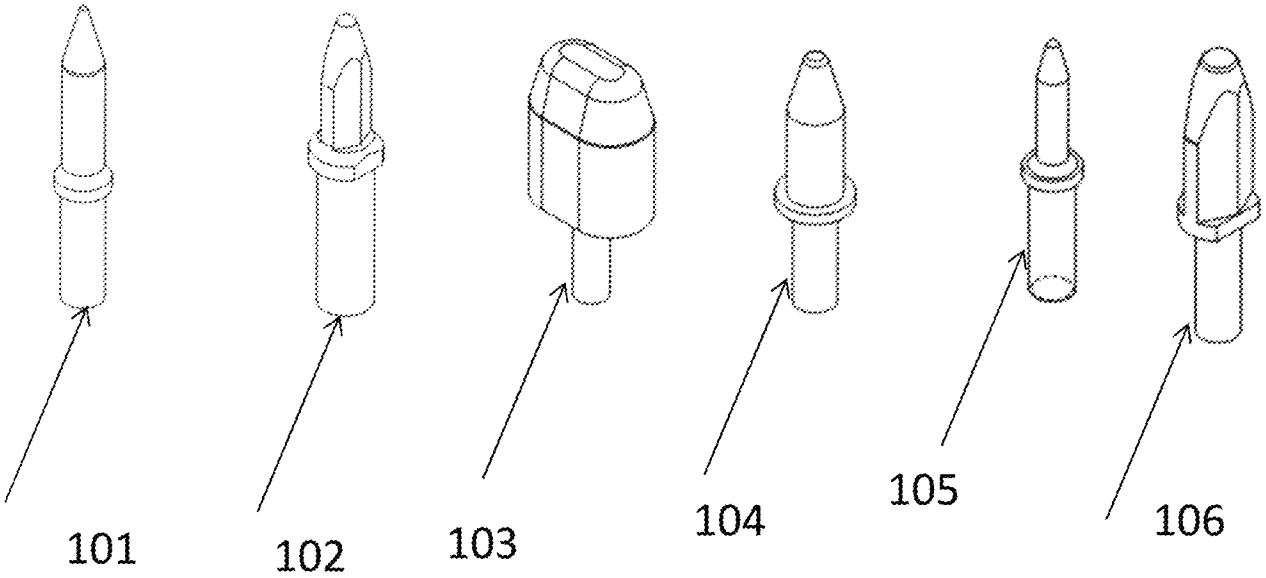
FIG. 1 is an isometric view of various geometries of coated locator pins.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein being contemplated as would normally occur to one skilled in the art to which the disclosure relates.

This disclosure generally relates to locator pins with a metal core with a wear resistant and corrosion resistant coating along with other desirable properties such as low surface roughness. Additional desirable features for the locator pins include being able to be produced by non line of sight process (where the internal surfaces that are not directly visible can be coated uniformly), ability to be coated at room temperature, and being able to have the coating deposited by environmentally friendly processes.

Various methods to obtain ceramic coatings on metallic objects are described in literature. These include chemical vapor deposition, flame spraying, and sintering of ceramic material on the metallic surfaces. For example, U.S. Pat. No. 6,175,097 issued to Raghavan et al. on January 16, describes ceramic coatings on metals produced by chemical vapor deposition while U.S. Pat. No. 5,259,675 issued to Ischikawa et al. on Nov. 9, 19913 describes such coatings produced by flame spraying techniques. These methods have disadvantages such as high-temperature processing, with thinner coating (thinner than desired for several applications), and low bond strength between the metallic part and the ceramic coating. Further, the locator pins employing these thinner coatings have limited life and require frequent replacement. Lack of adequate wear resistance of these thinner coatings often results in undesirable dimensional change of the locator pins. Additional disadvantage of such thinner coatings is that the non-conductive coating is often partially eroded leading to undesirable changes in electrical resistance. Other methods include various surface hardening techniques such as heat treatment of the surfaces, physical vapor deposition, and chemical vapor deposition to produce hardened surfaces through formation of coatings with proper hardness properties. These methods have disadvantage of not providing electrical insulation needed for applications described above. As with methods previously mentioned, the locator pins employing these do not possess adequate thickness for long life and hence have limited life and require frequent replacement. Lack of adequate wear resistance of these thinner coatings often results in undesirable dimensional change of the locator pins.

In the present disclosure, methods of making coated pins for locator pin applications are described. Also disclosed are locator pins made from methods and concepts described in this description. The method involves starting with a metallic pin of required geometry. This metallic pin can be termed as a substrate. On this substrate a coating needs to be deposited at a desired location or section of the pin. Previous methods have included chemical vapor deposition as described in U.S. Pat. No. 6,175,097, flame spraying as described in U.S. Pat. No. 5,259,675, and sintering methods as described in United States Published Patent Application No. US2007/0154278 A1 by Schramm on Jul. 5, 2007. FIG. 1 illustrates a non-limiting example of a variety of pin geometries of coated locator pins 101, 102, 103, 104, 105, and 106 that are contemplated.

In one embodiment of the present disclosure, a ceramic coating is deposited on a metallic pin by a process called Plasma Electrolytic Oxidation process, hereafter the PEO process. PEO process is described in literature (see A. L. Yerokhin, et al, Surface & Coatings Technology, 122 (1999) p. 73). The coating deposited using this process will also be referred to in this description as PEO coating. The novelty of the present disclosure will be described using an aluminum pin as an example. In this disclosure, aluminum is understood to include pure aluminum, aluminum with additives, and/or aluminum alloys.

In experiments leading to the fabrication of these novel locator pins, PEO coating was deposited on uncoated aluminum pins. The process of application of PEO coating includes immersing a part on which a ceramic coating is required in an electrolyte which may be of a dilute alkaline solution such as potassium hydroxide (KOH). The part is electrically connected to a voltage source, so as to become one electrode in an electrochemical cell that includes a second electrode also referred to as counter-electrode, which is typically made from a material that does not react with the electrolyte such as steel. An electrical potential (AC or DC) of over 300 V is applied between these two electrodes which results in micro arcing at a surface of the part. This micro arcing is also referred to as plasma and modifies the surface of the part to create a dense and hard aluminum oxide layer with a microstructure different from that of the substrate. This process can be used to grow oxide coatings with thickness ranging from tens of microns to hundreds of microns on metals such as aluminum, magnesium and titanium, or alloys made of these metals.

As these resulting coatings have high hardness and a continuous structure acting as a barrier between the metallic core and the external atmosphere or substances, these coatings offer protection against wear, corrosion or heat as well as electrical insulation. This process of creating ceramic coatings for weld locator pins results in much longer life of the pins. Since the oxide layer is not deposited but is formed by using aluminum from the pin, a high-strength bond is formed between the aluminum pin and the coating. Hence, the interface between the metallic core and the ceramic coating has a microstructure different from microstructures obtained by other processes such as chemical vapor deposition and flame spray techniques.

It should be noted that instead of aluminum, aluminum alloys can be used as a core material for the pin. It should be further noted that instead of aluminum, magnesium and its alloys, titanium and its alloys can be utilized as a starting material for the pin. It will be noted by those of ordinary skill in the art that other metals and alloys capable of forming an oxide coating and combinations can be advantageously employed. It is foreseeable that ceramic coatings other than oxides or combination with oxides can be achieved through selection of proper processing conditions in the PEO process.

Figure 2:
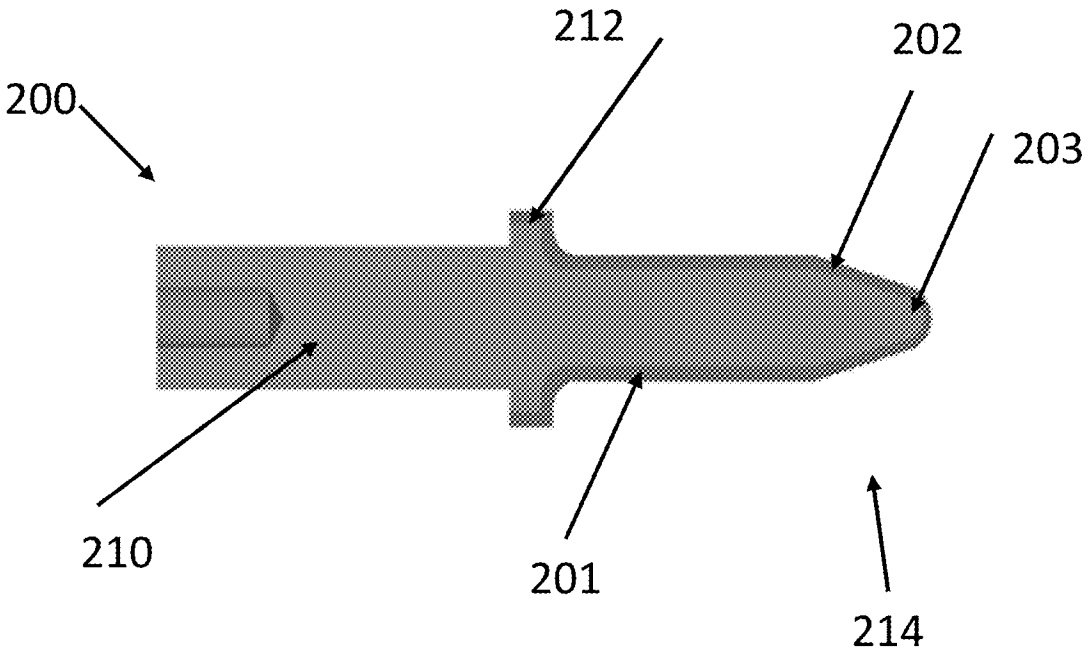
FIG. 2 is a sectional view of a locator pin with a ceramic coating deposited by Plasma Electrolytic Oxidation process.

FIG. 2 is one embodiment of the present disclosure and shows a schematic cross sectional representation of a locator pin 200 with a ceramic coating deposited by Plasma Electrolytic Oxidation process. Referring to FIG. 2, a locator pin, hereinafter the pin 200, that includes a metallic core 210 (in this case the metal is aluminum) coated with aluminum oxide according to the present disclosure is shown. In FIG. 2, aluminum oxide coating, hereafter the ceramic coating 212, is deposited by the PEO process on selected areas or portions 214 such as a shank portion 201 of the pin 200, a tapered portion 202 of the pin 200, and a tip 303 of the pin 200. The thickness of these coating varies only slightly throughout the coated areas of the pin and the coatings in all areas shown can be obtained in a single PEO process. It is clear that the coating deposited by the PEO process is in contact with the aluminum pin.

The PEO process provides more uniform thickness for the coating compared to other processes mentioned earlier to coat the metallic locator pins. While PEO coatings can vary between 2 micrometers to 100 micrometers, the preferred range for the ceramic coating on metallic locator pins is 20 to 70 micrometers. This thickness range is considerably larger than thicknesses obtained by other processes such as chemical vapor deposition. Ceramic coating thicknesses exceeding 300 micrometers have been obtained in our experiments with the PEO process. Optical microscopy of the ceramic coatings of the present disclosure has revealed that these coatings are dense (nearly free of porosity) and are well bonded to the substrate. These characteristics are due to the chemical reactions and intimate bonding achieved in the process.

Figure 3:
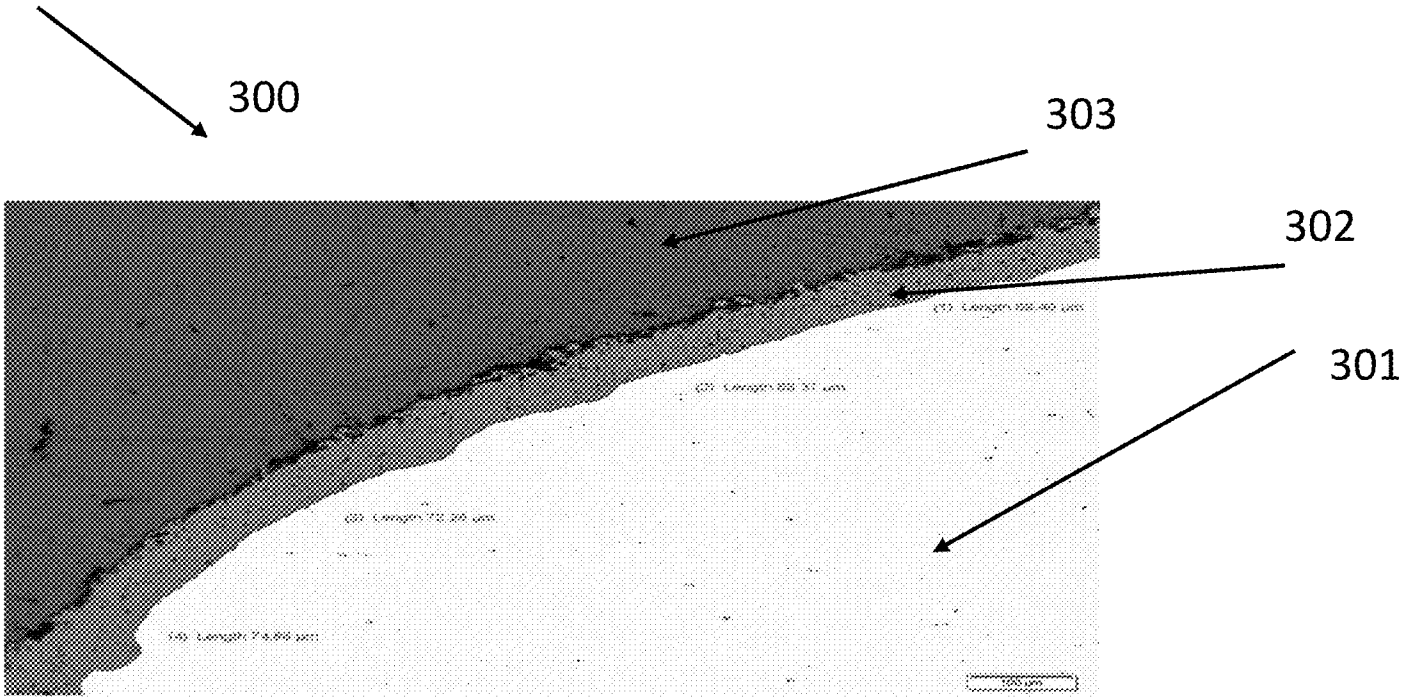
FIG. 3 is an optical micrograph (100× magnification) illustrating the non-porous high-density ceramic coating obtained on a locator pin by the PEO process.

FIG. 3 is an optical micrograph (100× magnification) illustrating the non-porous high-density ceramic coating obtained on a pin by the PEO process. FIG. 3 shows a micrograph of a section 300 of the pin 200 with the metallic core 301 which is comparable to the metallic core 210 of the pin 200. Shown in FIG. 3 is the PEO coating 302, which is comparable to the ceramic coating 212. The PEO coating 302 covers the metallic core 301 which is formed of aluminum in this case and thus the coating 302 is alumina. Area 303 is mounting material used in the sample preparation for micrography. Referring again to FIG. 3 the label "length" refers to the thickness of coating 302 at the indicated locations. It is noted that the instrumentation used to obtain this micrograph with labels indicates the thickness of the coating as "length". Thus "length" in this micrograph indicates the linear dimension of the coating thickness.

In one experiment of producing an oxide coating on an aluminum pin, the thicknesses measured varied from 46 micrometers to 71 micrometers, the highest thickness of 71 micrometers being at the tip of the pin. Also, measured surface roughness of the coating on the coated pin was 2.9 micrometers and was able to be reduced to 0.83 micrometers after a polishing step. Hardness of the coating was measured to be HV 1805 (Vickers Hardness scale) at the tip, HV 1901 at the taper and HV 1755 at the locating shank. Typical ranges of hardness for coatings of this disclosure can vary from HV 800 up to HV 2000.

The coatings deposited by the process of the present disclosure were subjected to wear resistance tests. Results of standard wear test (pin on disk method, well known to those skilled in the art) showed a factor of ten (10×) wear resistance improvement over lubricated AISI 4340 steel, also referred to as 4340 steel in this description. Steels of different compositions are designated by an AISI number and these designations and corresponding compositions are well known to those skilled in the art. AISI 4340 is a designation given by American Iron and Steel Institute for a steel with specific composition ranges for its constituents. In this test the wear resistance test pin was made of 4340 steel and the disk was made of 7075 Aluminum alloy with ceramic coating deposited using the PEO process. Corrosion tests using American Society for Testing and Materials (ASTM) B117 standard showed significantly superior performance compared to same thickness anodized samples. In a standard fatigue resistance test (ASTM E466-07 high cycle fatigue test) anodized aluminum oxide coating (with a thickness of 50 micrometers) survived about 30,000 cycles while the samples made with PEO process (with a thickness of 50 micrometers) survived about 38,000 cycles. This represents about 27% improvement in fatigue life.

It should be noted that the metallic pins subjected to the PEO process can be made of more than one metal layer. That is, a pin may be made of two layers, say, for example aluminum and titanium. The PEO process can be applied to such a pin as well and a ceramic coating can be deposited. Similarly, three or more layers of metallic nature are possible. It is intended that this disclosure encompasses multilayer metallic objects as substrates for a ceramic coating deposited by the PEO process. In such multilayer metallic structures the individual thicknesses of the metallic layer can be varied to obtain desired properties. The process of the present disclosure can be used to produce ceramic coated blades, blisks, disk rim sections, wires, foils, sheets, cylinders and blind holes. Further, these articles can be used as substrates for ceramic coatings and as such these articles can be made of several types of metals and alloys similar to as described in the case of locator pins. While the embodiments of this disclosure are described with reference to a particular geometry of a locator pin shown in FIG. 2, it will be obvious to those of ordinary skill in the art that the methods described here can be used with other geometries for locator pins, such as but not limited to, the geometries shown in FIG. 2.

Plasma Electrolytic Oxidation process is benefiting from advances in electronics and availability of high voltage and current power supplies will aid this technology to become more accessible for demanding applications. The PEO process is advantageously environmentally friendly since it does not involve chemical fumes, high temperatures and does not create any hazardous substances in coating manufacturing process.

Locator pins with ceramic coatings deposited by PEO process are useful products of this disclosure. Similarly, blades, blisks, disk rim sections, wires, foils, sheets, cylinders and blind holes having a ceramic coating deposited by PEO process are also objects and products of this disclosure. It is further envisaged that other useful articles requiring ceramic coatings possessing characteristics of the ceramic coatings obtained by the processed described in this description are also within the scope of this disclosure.

It will be understood by those of ordinary skill in the art that it is contemplated as within the scope of the disclosure to employ other materials (such as other metals and alloys) for the metallic pin and produce other ceramic coatings by tailoring plasma electrolytic oxidation process. Also, other thicknesses, surface roughness values, and hardness values can be obtained for the coatings by suitable adjustments to the process of coating.

Another aspect of this disclosure is directed towards achieving a coating of vanadium carbide deposited by a thermal diffusion process on locator pin coated containing a metallic core made of steel coated with vanadium carbide. Several varieties of steel can be used, a non-limiting example being 4340 steel. This metallic core made of steel can be termed a substrate. On this substrate a vanadium carbide diffusion coating is deposited on selected external surfaces of the pin. Previous methods of surface hardening such pins have included heat treatment, plasma spray, physical vapor deposition, chemical vapor deposition, among others.

In the present disclosure, by way of example and not limitation, a vanadium carbide thermal diffusion coating may be deposited on all areas of the pin or the selected areas 214 (FIG. 2) of the pin by techniques such as thermal diffusion process as described in literature (U.S. Pat. No. 4,440,581 issued to Baudis et al. on Apr. 3, 1984 and U.S. Pat. No. 5,482,578 issued to Rose et al. on Jan. 9, 1996.) and the process will not be discussed in detail here. As described in literature, Thermal Diffusion (TD) is a high-temperature surface modification process. The TD process can be used to form a carbide layer on carbon-containing materials such as steels, nickel alloys, cobalt alloys, cemented carbides and carbons. This carbide layer imparts high hardening to surface of the materials treated. The diffusion layer formed in the TD Process has shown itself to be superior to other coating processes. The thickness of the diffusion layer varies between 2 to 20 micrometers and is extremely dense and strongly bonded to the substrate. Higher thicknesses can be obtained through tailoring of process conditions.

TD-processed materials exhibit properties of carbides and nitrides such as high hardness and excellent wear resistance and corrosion resistance properties. Thus locator pins and other tools can benefit from such coatings. One type of TD process involves immersing parts in a fused salt bath containing vanadium kept at temperatures of 870 to 1040 degrees Centigrade for one to eight hours. Vanadium dispersed in the salt bath combines with carbon atoms contained in the substrate to form a vanadium carbide layer on the surface of the substrate.

The vanadium carbide layer deposited has a fine, non-porous microstructure. The bond formed by the coating with the substrate is metallurgical and the bond is through diffusion rather than by applying a coating by other methods. Vanadium carbide coating on steel guide pins can be formed by this process by selecting the composition of the salt bath appropriately, as known to those of ordinary skill in the art.

Another method of achieving the vanadium carbide coating involves packing the part in a metallic powder of suitable composition containing vanadium and other compounds and heating in a furnace for varying periods of time. More details of this process have been described in literature (U.S. Pat. No. 5,208,070 issued to Johnson, et al. on May 4, 1993.)

The thickness of the vanadium carbide coating of this disclosure on a steel pin obtained by TD process using metallic powders of suitable compositions containing vanadium (known to those of ordinary skill in the art) is in the range of 2 micrometers to 20 micrometers. A preferred thickness range for the vanadium carbide coating is 5 micrometers to 15 micrometers. This vanadium carbide diffusion coating is dense (with little porosity) and hard with a microstructure different from that of the substrate. The density and the good bonding of the vanadium carbide to the metallic core of the pin are due to the diffusion process creating an intimate bond between the metallic core and the vanadium carbide coating.

Figure 4:
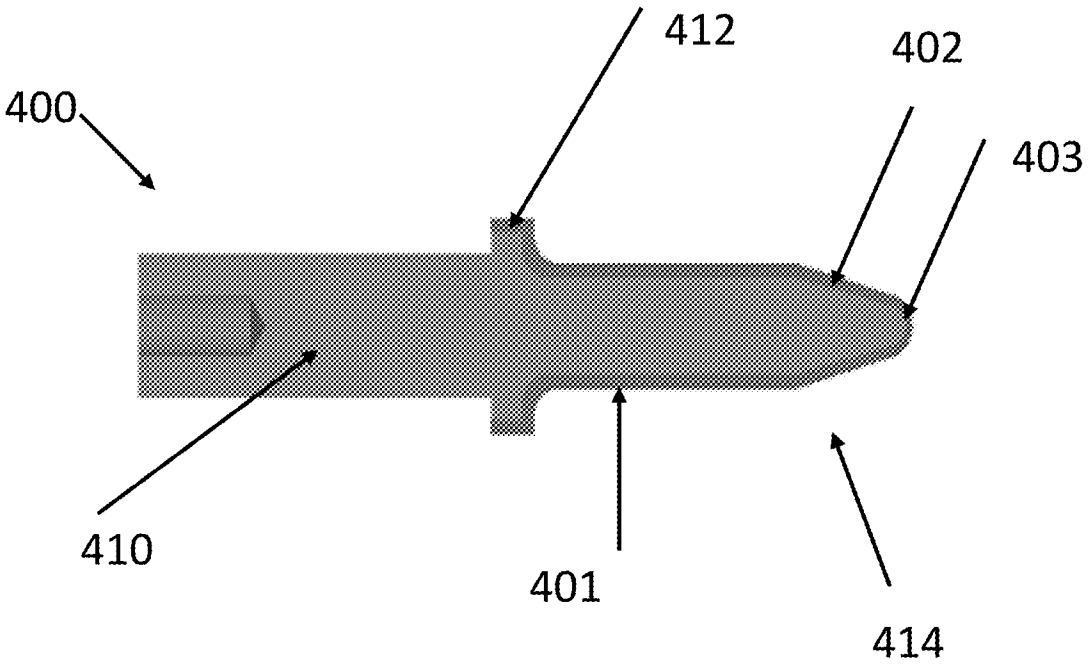
FIG. 4 is a sectional view of a steel pin coated with vanadium carbide coating according to the present disclosure.

FIG. 4 is a sectional view of a steel pin coated with vanadium carbide coating according to the present disclosure. Referring to FIG. 4, a locator pin, hereinafter the pin 400, that includes metallic core 410 (formed of steel in this case), coated with vanadium carbide according to the present disclosure is shown. The metallic core 410 can be made of steel. A non-limiting example of a steel amenable for depositing vanadium carbide layer is AISI 4340. In FIG. 4, vanadium carbide coating, hereafter the ceramic coating 412, is deposited by the TD process on selected areas 414, also referred to as portions in this description, of the metallic core 410 such as a shank portion 401 of the pin 400, a tapered portion 402 of the pin 400, and a tip 403 of the pin 400. The thickness of the vanadium carbide coating varies only slightly throughout the coated areas of the pin and the coatings in all areas shown can be obtained in a single TD process. It is clear that the coating deposited by the TD process is in contact with the steel pin.

The vanadium carbide coating described above and illustrated in FIG. 4 provides excellent wear resistance and corrosion resistance and provides a surface with low surface roughness.

In another embodiment of this disclosure, a first layer of a vanadium carbide coating is deposited on a steel pin as described above and the pin which is coated with the first layer of vanadium carbide is then coated with a diamond-like carbon coating. A coating of vanadium carbide deposited on the steel pin by a thermal diffusion process followed by a coating of diamond-like carbon on top of and in contact with said vanadium carbide coating. The combination of vanadium carbide coating and diamond-like carbon coating on top of and in contact with the vanadium carbide will hereinafter be also referred to as a composite coating. The term composite coating as used here can also mean more than two layers. Thus any coating that contains more than on layer is termed as a composite coating in this disclosure. To achieve a guide pin according to this aspect of the present disclosure, we start with a steel pin of required geometry and deposit a first layer of the composite coating, followed by a second layer of the composite coating. In one embodiment of this disclosure, the first layer is vanadium carbide and the second layer is diamond-like carbon (DLC). As mentioned earlier subsequent layers are possible.

Diamond-like carbon (DLC) exists as a form of amorphous carbon materials that display some of the typical properties of diamond. They are usually applied as coatings to other materials to have benefit of those properties. DLC coatings have no long-range crystalline order. Without long range order there are no brittle fracture planes, so such coatings are flexible and conformal to the underlying shape being coated, while still being as hard as diamond.

Methods of producing DLC include processes in which high energy precursive carbon atoms are rapidly cooled or quenched on relatively cold surfaces. Examples of such process are physical vapor deposition, chemical vapor deposition, plasma-enhanced chemical vapor deposition, cathodic arc deposition, sputter deposition and ion beam deposition. In experiments leading to the current disclosure DLC coating was deposited using a plasma-assisted chemical vapor deposition process. The plasma-enhanced chemical vapor deposition process which may also be referred to as a plasma-assisted chemical vapor deposition process has been well described in U.S. Pat. No. 4,668,365 issued to Foster et al. on May 26, 1987. The combination of the vanadium carbide coating and the diamond-like carbon coating on top of the vanadium carbide coating will be referred to in this description as a composite coating. In experiments leading to the present disclosure vanadium carbide coating was deposited by a TD process while DLC coating was deposited by plasma enhanced chemical vapor deposition process.

Figure 5:
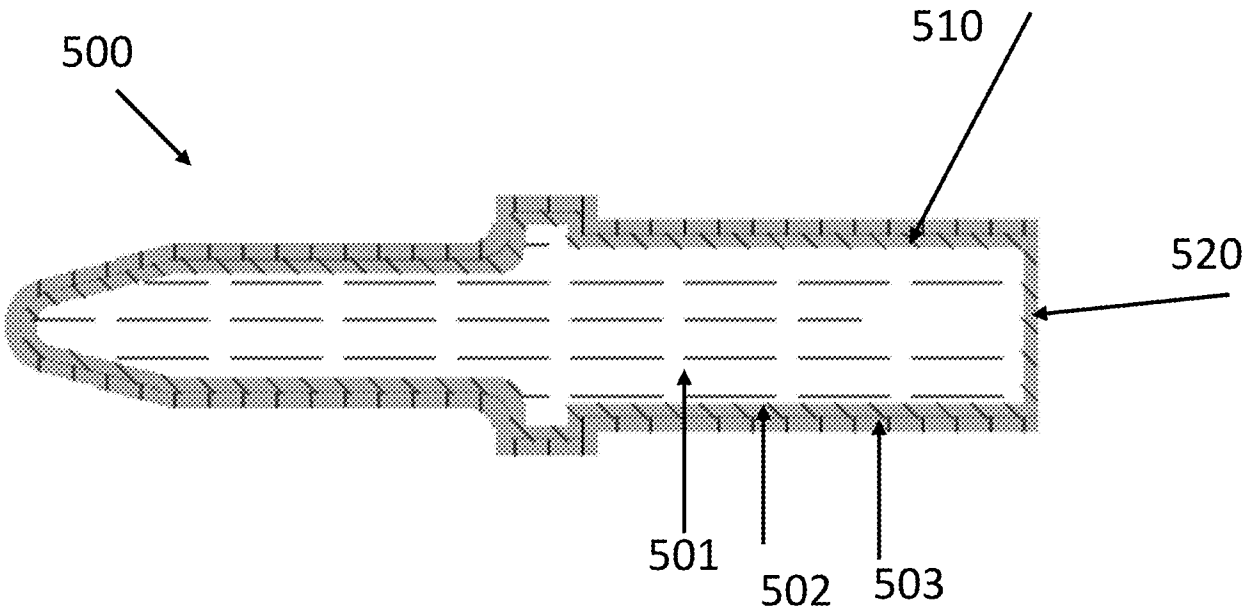
FIG. 5 is another embodiment according to this disclosure, showing a composite coating on a locator pin.

Another embodiment according to this disclosure is shown in FIG. 5. Shown in FIG. 5 is a locator pin 500 containing a metallic core 501 formed of steel, and a composite coating 510 comprising a first layer 502 of vanadium carbide coating, and a second layer 503 comprising a DLC coating on top of and in contact with the vanadium carbide coating. The locator pin 500 is coated with the composite coating 510, comprising vanadium carbide and diamond-like carbon, utilizing the processes described above. In FIG. 5, the dimensions are not to scale. It should be noted that in FIG. 5, most areas are coated with the composite coating, and an area 520 contains only the vanadium carbide coating. The TD process can be tailored by proper masking techniques known to those skilled in the art to create the composite coating on all or parts of the locator pin.

Figure 6:
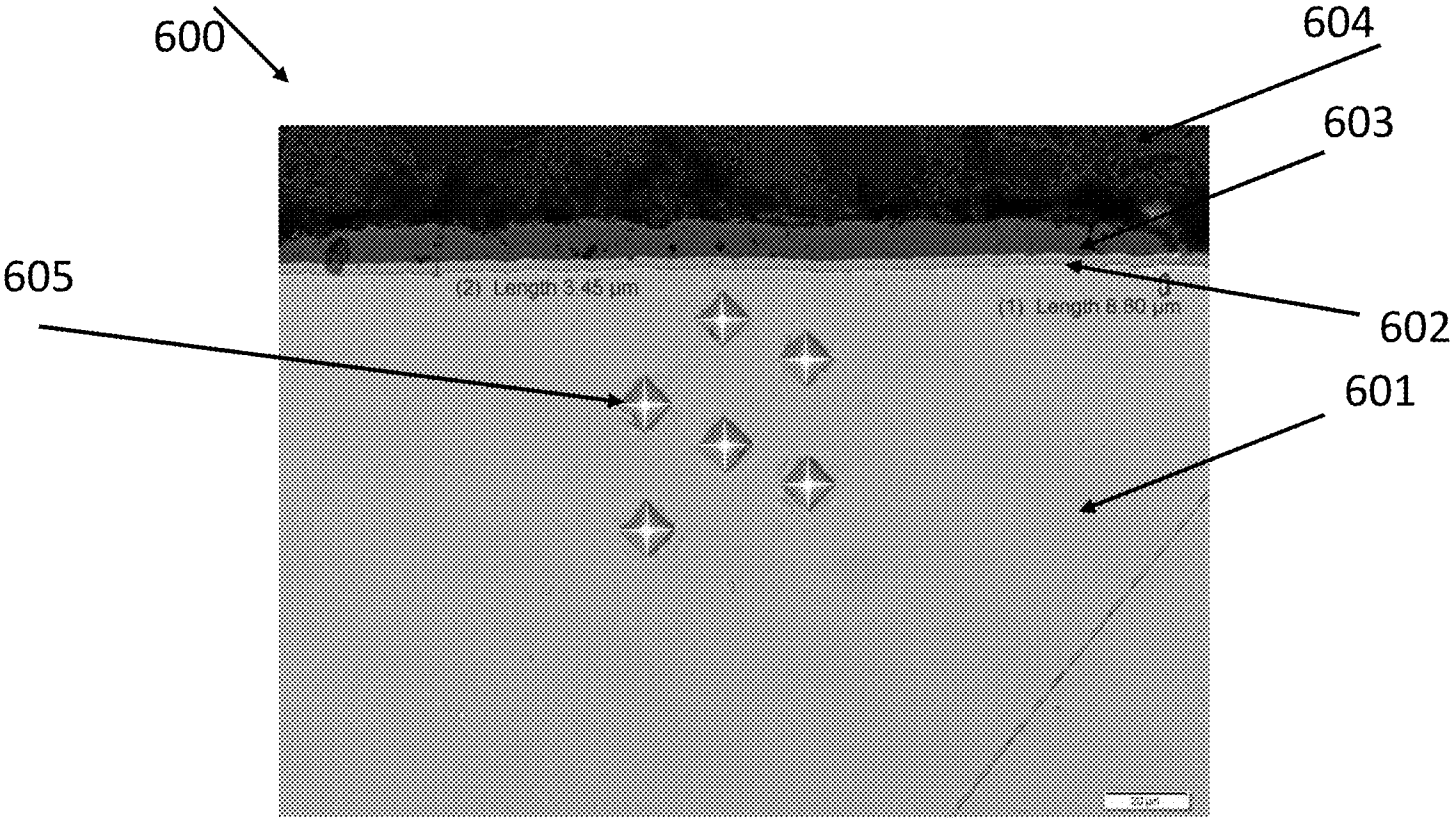
FIG. 6 is an optical micrograph of a section of a locator pin containing a composite coating.

FIG. 6 is a scanned image of an optical micrograph of a section 600 of the pin 500 (containing a composite coating) with the metallic core 601 which is comparable to the metallic core 501. Also shown in FIG. 6 are the first layer of the composite coating namely vanadium carbide coating 602

(which is comparable to the vanadium carbide coating 502, and the second layer of the composite coating, namely the DLC coating 603 (which is comparable to the DLC coating 503. Area 604 is mounting material used in the sample preparation for micrography. In FIG. 6, 605 are images of hardness testing indentations performed on the metallic core, while a scratch seen in the micrograph is an artifact of the sample preparation. Referring again to FIG. 6, the liable "length" refers to the thickness of coatings. In FIG. 6, (1) length is the thickness (8.8 micrometers) of the DLC coating at indicated location, and (2) length is the thickness (3.5 micrometers) of the vanadium carbide coating at the indicated location. This micrograph demonstrates achievability of the composite coating structure, and the dense coatings obtained on the pin as well as strong bond at the interfaces: (the metallic substrate)/(vanadium carbide) interface and (vanadium carbide/DLC) interface. It so happens that the instrumentation used to obtain this micrograph with labels indicates the thickness of the coating as "length". Thus "length" in this micrograph indicates the linear dimension of the coating thickness.

In an experiment of producing a composite coating of vanadium carbide and DLC on a steel pin, the composite coating thickness varied between 5 and 25 micrometers. The thickness of these composite coating is uniform throughout the geometry of the pin. These thickness values are considerably larger than thicknesses obtained by other processes such as chemical vapor deposition. Further the thickness can be greater than obtainable for surface heat treatment processes for the hardened surface layers. Qualitative evaluations have indicated wear resistance superior to guide pins made by other surface treatment techniques mentioned earlier. Further these pins can have superior life in applications wherein the pins are subjected to repeated friction. Fatigue life of pins with the composite coating is also expected to be superior to that of conventional pins subjected heat treatment alone.

Diamond-Like Carbon coatings have excellent wear resistance due to their increased hardness. DLC coatings as thin as a few (2-4 micrometers) micrometers have been known to have excellent wear and abrasion resistance properties. However, DLC coatings as thin as 2-4 micrometers may not have adequate electrical insulation for some applications. Thus thicker DLC coatings, in addition to increased wear resistance, provide excellent electrical insulation for some crucial applications such as guide pins used in electrolytic processes and welding. The embodiments of this disclosure provide locator pins with DLC coating, as part of the composite coating, in thickness ranges 2 to 50 micrometers, providing excellent wear resistance and excellent electrical insulation.

The metallic pins with the composite coating of vanadium carbide coating and DLC coating described above can be made of a metal or alloy containing carbon in order to provide carbon for carbide formation in a thermal diffusion process. An example of such metallic pin is a pin made of steel or steel alloy. The composite coating of vanadium carbide and diamond-like carbon can be deposited on such a steel pin as well and a coated steel pin can be produced. It should be noted that the metallic pins can be made of more than one metal layer. That is, a pin may be made of two layers of metal. The composite coating of vanadium carbide and diamond-like carbon can be deposited on such a pin as well and a coated pin can be produced. Similarly, three or more layers of metallic nature are possible. It is intended that this disclosure encompasses multilayer metallic objects as substrates. In such multilayer metallic structures the individual thicknesses of the metallic layer can be varied to obtain desired properties. A requirement for these metallic structures is that they should lend themselves to vanadium carbide formation in a thermal diffusion process.

The process of the present disclosure can be used to produce vanadium carbide coating with overlying diamond-like carbon coating on blades, blisks, disk rim sections, wires, foils, sheets, cylinders, and blind holes. Further, these articles can be used as substrates for the composite coating described above and as such these articles can be made of several types of metals and alloys similar to as described in the case of metallic locator pins. While this disclosure of composite coating with vanadium carbide and DLC coating is described with reference to one geometry of a locator pin shown in FIG. 3, it will be obvious to those of ordinary skill in the art that the methods described here can be used with other geometries for locator pins, such as but not limited to, the geometries shown in FIG. 2.

Locator pin with a metallic core made of steel needs to contain adequate carbon content, in order to be amenable to deposit a vanadium carbide coating on the metallic core. If a metallic core made of a type of steel that may have in adequate carbon content is used, it may be necessary to have a carburization step before subjecting the locator pin with a metallic core made of steel to provide the carbon content necessary for the process of depositing the first layer 502 comprising vanadium carbide. There is no set number for the adequate carbon content. It will be dependent on the process parameters (such as temperature and time, the extent of carbide layer required etc.). A number, as a non-limiting example, for adequate carbon content in the steel is 0.3 percent. Higher and lower numbers than 0.3 percent are possible to indicate an adequate carbon content for the steel to be mineable to a carbide coating by TD process. Thus in another embodiment of the disclosure a carburizing step may precede the depositing of the vanadium carbide coating and subsequently DLC coating.

Locator pins with a composite coating of vanadium coating with a diamond-like carbon coating over said vanadium carbide coating are useful products of this disclosure. Similarly, blades, blisks, disk rim sections, wires, foils, sheets, cylinders and blind holes having a ceramic coating deposited by the processes described in this description are also objects and products of this disclosure. It is further envisaged that other useful articles requiring coatings possessing characteristics of the composite coating obtained by the processes described in this description are also within the scope of this disclosure.

It should be noted that in many applications only the selected areas (214 or 414) on surface of a pin may be coated either to preserve dimensions of a section of a pin or to maintain electrical conductivity required by processes employed to achieve the coatings. This disclosure encompasses pins either coated entirely on the surface of the pin or coated on the selected areas 214 or 414 of the pin.

While this disclosure on composite coating of vanadium carbide and DLC coating is described largely in terms of a steel pin, we envisage this disclosure to cover many other materials as core material for the pins. In particular, instead of a steel pin, pins made of other ferrous alloys containing carbon can be used as base material for making the locator pin or guide pin. It is foreseeable that many other metals and alloys lend themselves to have such composite coatings described in this disclosure. Non-limiting examples of such metals and alloys include nickel-based and cobalt-based alloys. Further, instead of vanadium carbide coating other carbide coatings can be employed. In addition nitride coatings can be deposited instead or in addition to carbide coatings. It is clear from this description that we can have pins coated with vanadium carbide alone or coated with a composite coating containing two layers, the first layer in contact with the pin being vanadium carbide and a second layer of DLC in contact with the vanadium carbide coating.

It should be noted that while in this disclosure, composite coating of vanadium carbide and diamond-like carbon is deposited on steel guide pins, one can apply such composite coating to metallic guide pins and other metallic objects already having a ceramic coating on them, such as alumina or titania, or other similar ceramic coatings or combination of coatings, provided a source of carbon can be provided in those coatings so as to be able to form vanadium carbide in a TD process.

It should also be noted that the coatings on a locator pin of this disclosure prevent weld splatter from adhering to the coated areas, and prevents the locator pin from acting as a shorting path during welding of parts located by the locator pin.

It will be understood by those of ordinary skill in the art that it is contemplated as within the scope of this disclosure to employ other materials (such as other metals and alloys) for the metallic pin and produce other multilayer and/or composite coatings by tailoring the described processes. Also, many variations of thicknesses, surface roughness values and hardness values can be obtained for the coatings by suitable adjustments to the process of obtaining the composite coating.

While the disclosure has been described in terms of specific embodiments, including particular configurations, metal and ally compositions, coating compositions and properties, it is apparent that other forms could be adopted by one skilled in the art. Accordingly, it should be understood that the disclosure is not limited to the specific disclosed embodiments. Therefore, the scope of the disclosure is to be limited only by the following claims.

The invention claimed is:

1. A locator pin comprising:

a metallic core that defines selected areas of the metallic core; and a composite coating characterized as wear resistant, corrosion resistant, and electrically insulating, wherein the composite coating comprises a first coating comprising vanadium carbide in the thickness range of 2 micrometers to 20 micrometers deposited on selected areas of the metallic core; and a second coating comprising diamond-like carbon in the thickness range of 2 micrometers to 50 micrometers overlaying and in contact with the first coating.

2. The locator pin of claim 1, wherein the metallic core is made of steel.

3. The locator pin of claim 1, wherein the metallic core is made of a ferrous alloy containing carbon.

4. The locator pin of claim 1, wherein the selected areas comprise a shank portion, a taper portion, and a tip portion of the metallic pin.

5. The locator pin of claim 1, wherein the thickness of the vanadium carbide coating is in the range of 5-10 micrometers.

6. The locator pin of claim 1, wherein the thickness of the diamond-like carbon coating is in the range of 15-40 micrometers.

7. The locator pin of claim 1, wherein one or more coatings are added over the second coating.

* * * * *